United States Patent [19]

Reay et al.

[11] 4,270,569

[45] Jun. 2, 1981

[54] VALVE ASSEMBLY FOR THE REMOTE CONTROL OF FLUID FLOW HAVING AN AUTOMATIC TIME DELAY

[75] Inventors: Robert G. Reay; Ronald Rachuk, both of Rocky Mountain House, Canada

[73] Assignee: Christensen Inc., Salt Lake City, Utah

[21] Appl. No.: 951,344

[22] Filed: Oct. 16, 1978

[51] Int. Cl.[3] ..... F16K 15/06; F16K 21/10

[52] U.S. Cl. ..... 137/514.7; 166/325

[58] Field of Search ..... 137/514, 514.7, 514.3, 137/514.5, 540, 542, 536; 166/325

[56] References Cited

U.S. PATENT DOCUMENTS

| | | | |
|---|---|---|---|
| 956,789 | 5/1910 | Allan | 137/514 |
| 1,379,092 | 5/1921 | Fraccascia et al. | 137/514.7 |
| 2,142,410 | 1/1939 | Quick | 137/514.7 X |
| 2,927,604 | 3/1960 | Johnson | 137/514.5 |
| 3,698,411 | 10/1972 | Garrett | 137/536 X |
| 3,698,426 | 10/1972 | Litchfield et al. | 166/325 X |

*Primary Examiner*—William R. Cline
*Attorney, Agent, or Firm*—Stanley G. Ade

[57] ABSTRACT

A downhole float valve is normally closed by a spring or other means of applying axial pressure until sufficient pressure of drilling fluid from the surface opens the valve. The valve stem includes a dashpot type housing secured thereto and moving within a fluid filled cylinder. When the valve opens, the movement is controlled by a one-way valve in the housing giving a relatively rapid opening. When pressure of the drilling fluid from the surface is removed, the pressure on the underside of the valve typically assisted by the spring, closes the valve. An adjustable bleed passage in the housing delays this closing for a pre-determined time thus allowing the pressure on the underside of the valve to balance with the pressure on the other side of the valve, but preventing an hydraulic lock or an hydraulic "stuck" situation from occurring.

8 Claims, 5 Drawing Figures

VALVE ASSEMBLY FOR THE REMOTE CONTROL OF FLUID FLOW HAVING AN AUTOMATIC TIME DELAY

BACKGROUND OF THE INVENTION

This invention relates to new and useful improvements in the remote control of fluid flow utilizing a valve incorporating an automatic time delay.

In certain industrial applications, it is beneficial to have control over a distant fluid flow in such a way that some predictable delay is incorporated automatically between the actuating means and the function being controlled.

Although the present description and drawings relate to oil well drilling, nevertheless the device can be used in other industrial applications.

In the drilling of petroleum exploratory wells, it is desirable to control and therefore prohibit, the passage of natural gas from the downhole drilling bit location to the earth's surface through the borehole annulus and also through the hollow drill stem itself.

Such control is mandatory for the prevention of costly "blowouts" that may occur in the process of drilling wells for the recovery of petroleum products.

Conventionally, control of gas flow through the bore-hole annulus is by means of "blowout preventers" installed at the surface and some control is exercised over the passage of gas through the interior of the drill stem by means of a downhole "float valve" and the present invention relates primarily to improvements in downhole "float valve" assemblies.

The present downhole float valve assemblies often cause what is known as "hydraulic sticking" of the drill string. As the drill string is lowered into the borehole subsequent to bit changing or the like, the lower members of the drill string (the drill collars) often become coated with various matter (e.g. cuttings and/or mudcake) suspended in the drilling fluid and when the interior of the drill string is subjected to the drilling fluid pressure imposed by the surface pumps, the drilling fluid itself causes the downhole float valve to open thereby permitting the passage of drilling fluid down through the drill bit and into the borehole annulus where it normally would proceed back to the surface.

However, the material in suspension in the annulus fluid sometimes becomes compressed upwardly as a result of the surface pump pressure thus causing a complete or partial blocking of the annulus route intended for the return of the drilling fluid to the surface.

The continuing application of pressure by the surface pumps therefore causes a downhole force imbalance in such a direction as to cause the float valve to close thereby leaving a section of the downhole annulus, pressurized, resulting in a hydraulically "stuck" situation.

In float valve applications, the present state of the art requires that some unlocking means by applied from the surface in order to break this hydraulic lock. Conventionally, a ball or dart or the like is dropped down the interior of the drill stem from the surface in order to attempt to open the valve, but this practice is generally unpredictable and unsatisfactory.

SUMMARY OF THE INVENTION

The main purpose of the apparatus disclosed herein is to permit the balancing of the aforementioned downhole pressures by means of a float valve that incorporates an automatic time delay feature, such that back pressure may be relieved up through the drill string while the valve remains in an open condition for a predetermined length of time.

There is disclosed herein a time delayed float that may be installed at the lower end of a typical drill string and having the following features:

(a) The valve is normally closed or partially closed, and is influenced in this condition by means of a helical spring.

(b) The application, in the downstream direction, of normal pressure exerted by surface pumps for the purpose of circulating drilling fluid down through the interior of the drill stem, through the drill bit, and back to the surface through the bore hole annulus, will cause the present valve to open relatively quickly, permitting the unimpeded flow of drilling fluid.

(c) The removal of the pressure exerted by the surface pumps, creating at the bit a pressure differential in the reverse direction to that associated with normal drilling fluid circulation, will cause the present valve to close gradually (typically over a four minute period), thereby permitting the pressure to equalize between the annulus and the drill string interior at the bit.

(d) The contained helical spring or other source of axial pressure shall keep the valve in the closed condition until adequate downstream pressure is once more applied.

(e) Additional pressure that may be encountered in, for example, a downhole gas-bearing formation, will act in an upstream direction such that additional force is applied to keep the present valve in the closed position-preventing venting of such gas to the surface through the drill string.

(f) The partially closed valve will also prevent the flow of relatively large chips or other solids into the drill stem while the bit is being run to the bottom of the hole. This will reduce the possibility of subsequent plugging of the bit nozzles by matter suspended in the drilling fluid.

One aspect of the invention consists of a float valve assembly for the remote control of the fluid flow comprising in combination a cylindrical casing, a fluid passageway extending axially through said casing and a valve assembly within said passageway dividing said passageway into one portion above said valve assembly and another portion below said valve assembly, said valve assembly including a valve seat in said passageway, a valve normally engaging said valve seat and sealing of said passageway, means normally maintaining said valve upon said seat until a predetermined pressure of fluid through said passageway from said one portion thereof, moves said valve from said seat against the pressure of said means, means to control the movement of said valve from said seat and time delay means to control the movement of said valve onto said seat when back pressure of fluid from said other portion of said passageway below said valve is greater than the pressure of fluid within said one portion of said passageway above said valve seat.

With the foregoing in view, and other advantages as will become apparent to those skilled in the art to which this invention relates as this specification proceeds, the invention is hereby described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
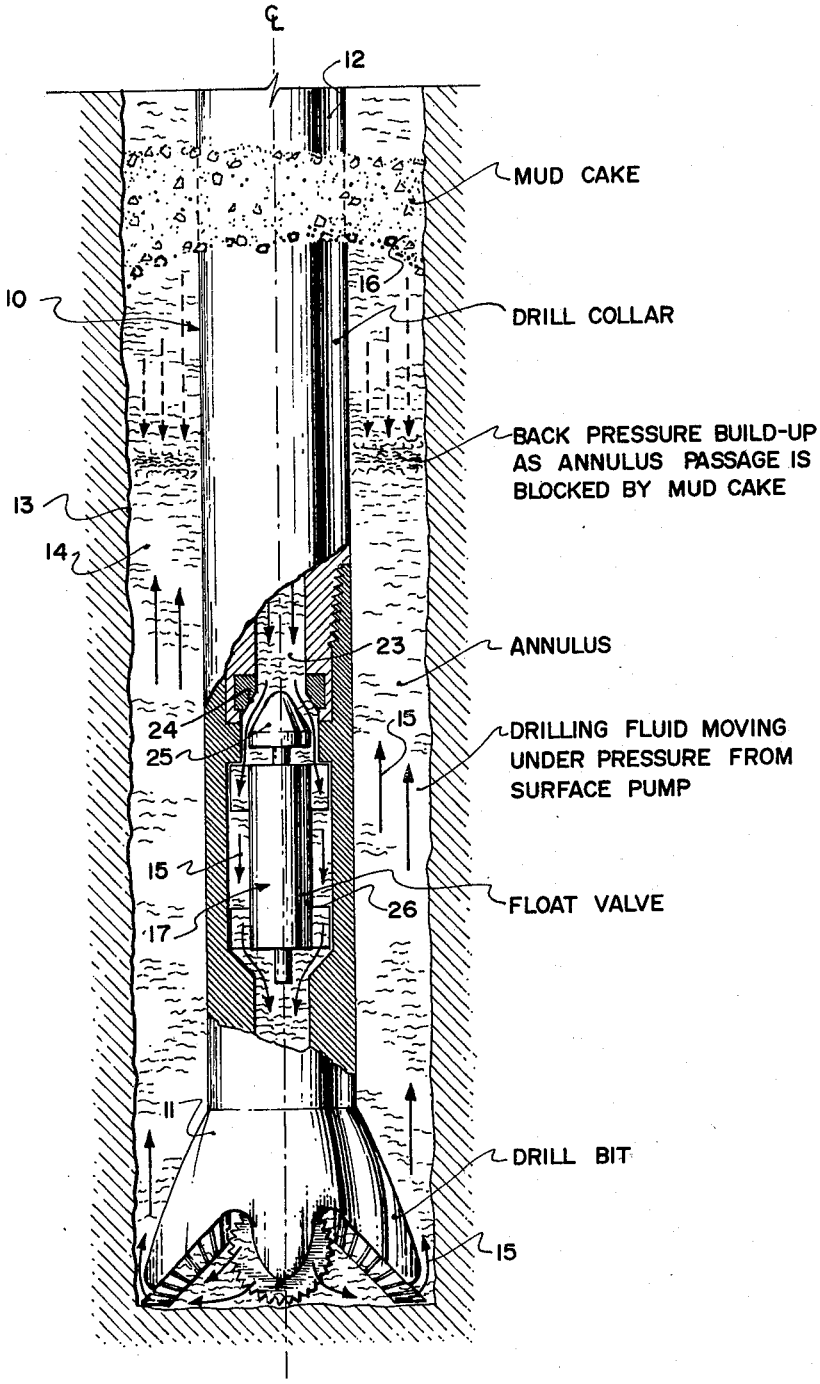
FIG. 1 is a cross sectional partially schematic view of the invention shown at the bottom of a bore hole.

Proceeding to describe the invention in detail, reference should first be made to FIG. 1 in which the invention collectively designated 10 is situated immediately above a drill bit 11 to which it is attached. The drill string 12 is secured to the other end of the invention sub 10 and extends to the surface (not illustrated).

Within the bore hole 13, an annulus 14 is formed around the invention sub and drill string and it is normal for drilling fluid to pass downwardly through the drill string, through the drill bit 11 and then upwardly through the annulus as shown by arrows 15.

As will be seen from the legend attached to FIG. 1, back pressure sometimes builds up within the annulus as the passageway is blocked by mudcake or other suspended solids illustrated by reference character 16 thus causing, in conjunction with the float valve assembly 17, an hydraulic lock or an hydraulically "stuck" region between the float valve assembly and the blocking matter.

Figure 2:
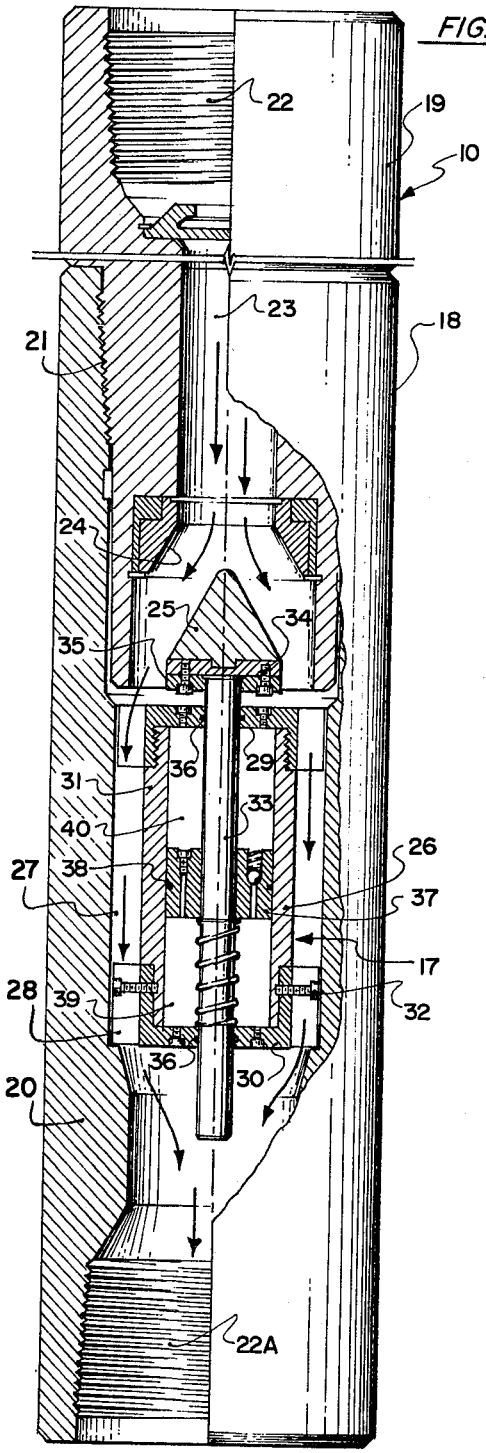
FIG. 2 is a partial longitudinal section and partially broken away view of the invention incorporated within a cylindrical casing.
Figure 3:
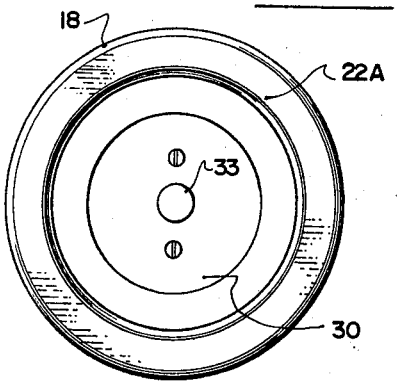
FIG. 3 is an end view of FIG. 2 taken from the right-hand end thereof.
Figure 4:
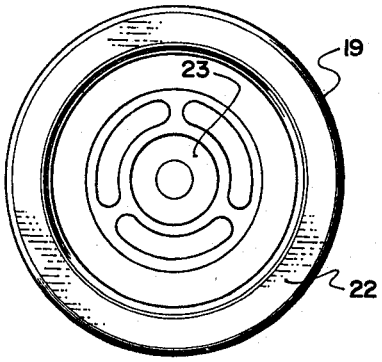
FIG. 4 is an end view of FIG. 2 taken from the left-hand end thereof.

Reference should next be made to FIG. 2 in which the invention collectively designated 10 comprises a substantially cylindrical casing 18 taking the form of a top sub 19 threadably engageable with a bottom sub 20 by means of a modified tool joint 21.

A conventional tool joint 22 at one end of the top sub 19 permits the top sub to be connected to a lower end of the drill string in the usual manner and a similar tool joint 22A at one end of the bottom sub, enables the bit 15 to be secured thereto in the usual way.

Situated within the cylindrical casing 18 is the aforementioned float valve assembly collectively designated 17.

An axial passageway 23 extends through the subs 19 and 20 with the float valve assembly 17 being situated within the passageway.

A conical valve seat 24 is provided at the lower end of the passageway 23 extending through the top sub 19 and a conical valve 25 normally engages within this valve seat 24 thus partially or completely closing off the passageway 23 unless sufficient pressure of fluid through passageway 23, is provided in order to move the valve 25 from seat 24 as will hereinafter be described.

Situated within the bottom sub 20, is a cylindrical housing 26 held axially within the passageway 27 in the bottom sub, by means of top and bottom spiders 28 or the like and this cylindrical housing includes an upper closed end 29 and a lower closed end 30. The upper closed end is in the form of a cap screw threadably engaging the main cylindrical portion 31 and the lower closed end 30 slidably engages over a shoulder formed on the lower end of the housing 31 and is held in position by means of set screws 32.

The valve head 25 includes a cylindrical valve stem 33 secured to the valve head 25 by means of set screws 34 extending through a flanged end 35 of the valve stem and this cylindrical valve stem extends through the end caps 29 and 30 in a sliding relationship, seals 36 being provided to maintain a sealed relationship between the reciprocal valve stem and the interior of the cylindrical housing 31 which is filled with a fluid such as a silicone oil or the like (not illustrated).

Secured to the valve stem within the cylindrical housing 31 is a dashpot type housing 37 including seals 38 thereby dividing the cylindrical housing or hydraulic chamber into a first part 39 and a second part 40.

Figure 5:
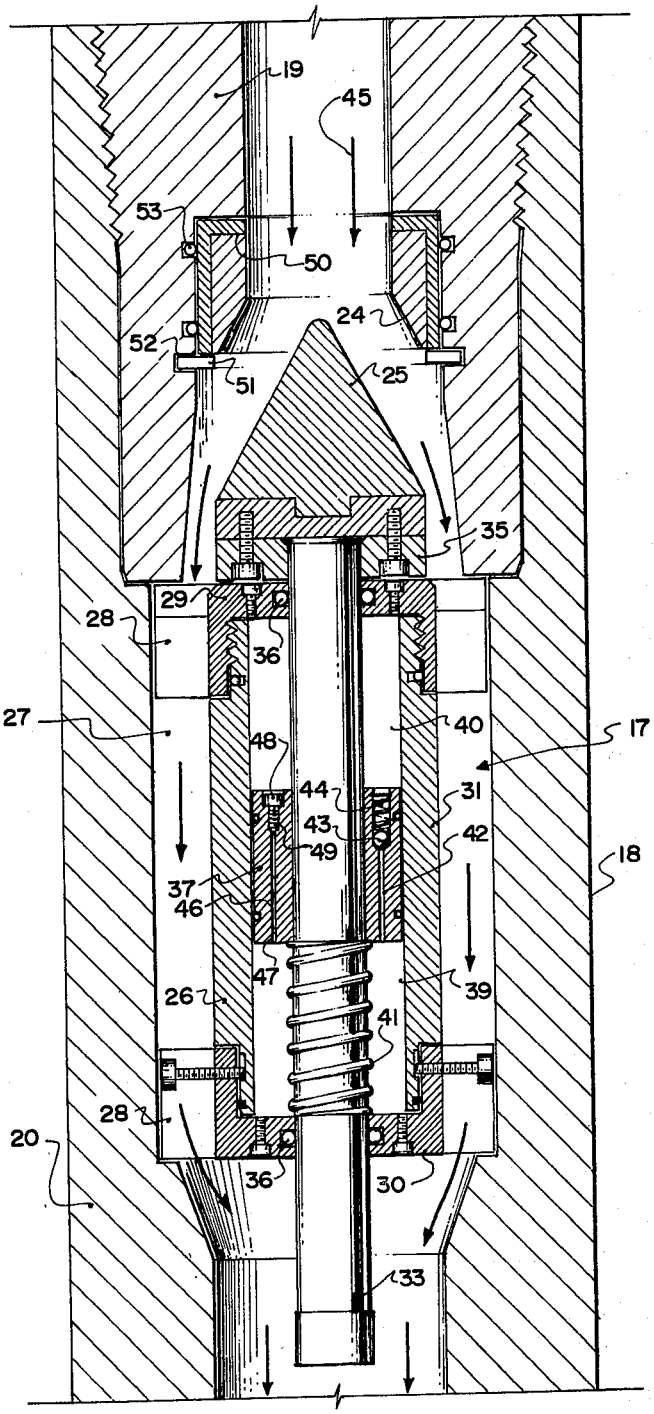
FIG. 5 is an enlarged cross-sectioned view of the valve assembly per se.

Reference to FIG. 5 will show details of this portion of the invention. A coiled helical compression spring (for example) 41 extends around a portion of the valve stem below housing 37 and reacts between the end 30 of the hydraulic chamber and the housing thereby normally urging the housing together with the valve stem and valve, in the direction of the valve seat 24 and thereby normally maintaining the valve head 25 upon valve seat 24.

When sufficient pressure of drilling fluid from the surface, is present in order to overcome the pressure of the spring 41, the valve head together with the valve stem and housing 37, moves downwardly towards the drill bit and this movement is controlled by a passageway or bore hole 42 through the housing communicating between the first and second chambers 39 and 40. A one-way spring loaded check valve 43 is provided within the bore hole 42 and this moves from its seat against pressure of the spring 44 thus allowing the transfer of fluid as the first part 39 decreases in volume and the second part 40 increases proportionally.

The diameter of the bore hole or passage 42 together with the nature of the ball valve and spring assembly 43 is such that a relatively fast transfer of fluid from the part 39 to the part 40 is permitted.

The valve remains in the open condition for as long as adequate pressure is applied in the downstream direction indicated by arrows 45.

However, upon removal of downstream pressure, the typical helical spring 41 together with such upstream pressure as may be present, acts in a direction to close the valve 25 upon seat 24. It will be observed that under these conditions the ball valve 43 is closed so that the bore hole or passage 42 is closed.

Various time delays are built into the design of the device in order to control the time taken for the valve 25 to close upon seat 24 and in this embodiment, a bleed passage or jet valve assembly 46 is provided through the dashpot housing 37. The bleed passage 47 extends through the housing from the part 39 of the hydraulic chamber and an adjustable jet valve 48 screw threadably engages an enlarged other end 49 of the bleed passage so that the flow of fluid through the bleed passage is controlled within limits.

Typically, the valve 48 is adjusted so that a time delay of approximately four minutes occurs between the start of the closing valve 25 and the engagement thereof with the seat 24.

It will also be noted that the arrangement of parts of this assembly is such that the maintenance of the assembly is improved and that adequate seals are provided with respect to both the containment of the self-contained hydraulic fluid within the hydraulic chamber and the flow of fluid being controlled and automatically accommodating inadvertent changes, e.g. thermal expansion, in the volume of the contained hydraulic system. In this connection, a release valve (not illustrated) may be incorporated.

In operation, the time delay float valve is contained in the lowermost section of the drill string with the drill bit connected to the lower end thereof.

As the drill string is lowered into the fluid filled drill hole (for example, after a bit change), the valve 25 remains partially closed therefore permitting drilling fluid within the drill hole to enter the string from the bottom end, but excluding the larger solid matter. Once at the bottom of the drill hole, the energizing of the surface "mud" pumps (not illustrated) forces drilling fluid down into the interior of the drill string creating a pressure that overcomes the helical spring pressure 41 thereby permitting valve 25 to move from seat 24 as hydraulic fluid is transferred from the first part 39 to the second part 40 of the hydraulic chamber or housing 31. This is through the action of the spring loaded ball valve assembly 43 and the passageway 42 within the dashpot type housing 37.

As long as drilling fluid is circulating down through the drill string stem, through the bit and back to the surface through the bore hole annulus 14 (see FIG. 1), the valve 25 remains in the open position. However, when the pressure is discontinued by the surface pump, a pressure differential will be created across the valve 25 so that force will be applied by the helical spring 41, in a direction to close the valve 25 upon the seat 24.

However, because the closing of the valve is controlled and delayed by the movement of the hydraulic fluid from the second part 40 to the first part 39 through the bleed passage 47, there is a deliberate time delay introduced into the valve closing operation.

This will permit the "bleeding" of the pressure differential back to the surface through the interior of the drill string, followed after the time delay, by a positive closing of the fluid flow path in the upstream direction by means of valve 25 engaging seat 24.

This time delay may, as hereinbefore described, be adjusted within limits, by means of the bleed screw 48.

It is preferable that the valve head 25 be formed from tungsten carbide or the like and that the valve seat 24 be formed from a similar material. In this connection, the valve seat 24 is preferably detachable and is inserted within a cylindrical recess 50 and held in position by means of a split ring 51 seated within an annular groove 52 with annular seal 53 being provided around the seat and the wall of the bottom sub 19 as clearly shown in FIG. 5.

Mudcake and/or drilling cuttings or other matter may be removed by bleeding back any pressure through a surface valve up the drill stem and then moving the drill string up and down and/or rotating the string and regaining circulation, thus allowing a return to drilling.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What we claim as our invention is:

1. A float valve assembly for the remote control of the fluid flow comprising in combination a cylindrical casing, a fluid passageway extending axially through said casing and a valve assembly within said passageway dividing said passageway into one portion above said valve assembly and another portion below said valve assembly, said valve assembly including a valve seat in said passageway, a valve normally engaging said valve seat and sealing said passageway, spring means normally maintaining said valve upon said seat until a predetermined pressure of fluid through said passageway from said one portion thereof, moves said valve from said seat against the pressure of said means, means to control the movement of said valve from said seat and time delay means to control the movement of said valve onto said seat when back pressure of fluid from said other portion of said passageway below said valve is greater than the pressure of fluid within said one portion of said passageway above said valve seat, a stem extending from said valve towards said other portion of said passageway, a fluid containing cylinder having closed ends, mounted axially within said other portion of said passageway, said valve stem extending axially through said cylinder and being in sealing reciprocal relationship with the closed ends of said cylinder, said means to control the movement of said valve and said time delay means both being situated within said cylinder and a dashpot type housing secured to said valve stem and reciprocal within said cylinder thereby dividing said cylinder into a first part and a second part, said means to control the movement of said valve from said seat including a bore hole extending through said housing and communicating between said first and second part of said cylinder, and a one-way valve operatively mounted in said bore hole, said one-way valve opening when said first mentioned valve is moving away from said valve seat thereby transferring fluid between said first and second part of said cylinder at a predetermined rate of flow.

2. The invention according to claim 1 which includes a dashpot type housing secured to said valve stem and reciprocal within said cylinder thereby dividing said cylinder into a first part and a second part, said time delay means to control the movement of said valve onto said seat includes a bleed passage extending through said housing and communicating between said first and second part of the cylinder, the rate of flow through said bleed passage, when said valve is moving towards said valve seat, controlling a time delay of the closing of said valve upon said valve seat.

3. The invention according to claim 2 in which said bleed passage includes an adjustable valve for varying the rate of flow of fluid therethrough and hence the time delay of the closing of said first mentioned valve upon said valve seat.

4. The invention according to claims 1, or 3 in which said spring means comprises a helical coil compression spring surrounding said valve stem within said cylinder and reacting between one end of said cylinder and one end of said housing and normally urging said housing and hence said valve, towards said valve seat.

5. In a float valve assembly for the remote control of fluid flow and which includes a cylindrical casing, and a fluid passageway extending through said casing, the improvement comprising a valve assembly within said passageway dividing said passageway into one portion above said valve assembly and another portion below said valve assembly, said valve assembly including a valve seat in said passageway, a valve normally engaging said valve seat and sealing said passageway, spring means normally maintaining said valve upon said seat until a predetermined pressure of fluid through said passageway from said one portion thereof, moves said valve from said seat against the pressure of said means, means to control the movement of said valve from said seat and time delay means to control the movement of said valve onto said seat when back pressure of fluid from said other portion of said passageway below said valve is greater than the pressure of fluid within said one portion of said passageway above said valve seat, a stem extending from said valve towards said other portion of said passageway, a fluid containing cylinder having closed ends, mounted axially within said other portion of said passageway, said valve stem extending axially through said cylinder and being in sealing reciprocal relationship with the closed ends of said cylinder, said means to control the movement of said valve and said time delay means both being situated within said cylinder and a dashpot type housing secured to said valve stem and reciprocal within said cylinder thereby dividing said cylinder into a first part and a second part, said means to control the movement of said valve from said seat including a bore hole extending through said housing and communicating between said first and second part of said cylinder, and a one-way valve operatively mounted in said bore hole, said one-way valve opening when said first mentioned valve is moving away from said valve seat thereby transferring fluid between said first and second part of said cylinder at a predetermined rate of flow.

6. The invention according to claim 5 which includes a dashpot type housing secured to said valve stem and reciprocal within said cylinder thereby dividing said cylinder into a first part and a second part, said time delay means to control the movement of said valve onto said seat includes a bleed passage extending through said housing and communicating between said first and second part of the cylinder, the rate of flow through said bleed passage, when said valve is moving towards said valve seat, controlling a time delay of the closing of said valve upon said valve seat.

7. The invention according to claim 6 in which said bleed passage includes an adjustable valve for varying the rate of flow of fluid therethrough and hence the time delay of the closing of said first mentioned valve upon said valve seat.

8. The invention according to claims 5, 13 or 7 in which said spring means comprises typically a helical coil compression spring surrounding said valve stem within said cylinder and reacting between one end of said cylinder and one end of said housing and normally urging said housing and hence said valve, towards said valve seat.

* * * * *